US005236565A

United States Patent [19]

Müller et al.

[11] Patent Number: 5,236,565

[45] Date of Patent: Aug. 17, 1993

[54] PROCESS OF PHOSPHATING BEFORE ELECTROIMMERSION PAINTING

[75] Inventors: Gerhard Müller, Hanau; Werner Rausch, Oberursel/Ts., both of Fed. Rep. of Germany

[73] Assignee: Metallgesellschaft Aktiengesellschaft, Frankfurt am Main, Fed. Rep. of Germany

[21] Appl. No.: 629,076

[22] Filed: Dec. 17, 1990

Related U.S. Application Data

[63] Continuation of Ser. No. 428,013, Oct. 26, 1989, abandoned, which is a continuation of Ser. No. 178,124, Apr. 6, 1988, abandoned.

[30] Foreign Application Priority Data

Apr. 11, 1987 [DE] Fed. Rep. of Germany ..... 3712339

[51] Int. Cl.[5] ..... C25D 13/20

[52] U.S. Cl. ..... 204/181.3; 148/262

[58] Field of Search ..... 204/181.3; 148/262

[56] References Cited

U.S. PATENT DOCUMENTS

| | | | |
|---|---|---|---|
| 4,486,241 | 12/1984 | Donofrio | 148/6.15 Z |
| 4,490,185 | 12/1984 | Gottwald | 148/6.15 Z |
| 4,539,051 | 9/1985 | Hacias | 148/6.15 Z |
| 4,657,600 | 4/1987 | Matsuda | 148/6.15 Z |
| 4,670,066 | 6/1987 | Schapira et al. | 148/6.15 |
| 4,681,641 | 7/1987 | Zurilla | 148/262 |

FOREIGN PATENT DOCUMENTS

| | | |
|---|---|---|
| 0175606 | 8/1985 | European Pat. Off. . |
| 3345498 | 6/1985 | Fed. Rep. of Germany . |
| 2203893 | 6/1976 | France . |
| 2044805 | 10/1980 | United Kingdom . |
| 2080835 | 2/1982 | United Kingdom . |
| 2137231 | 10/1984 | United Kingdom . |
| 2169620 | 7/1986 | United Kingdom . |

OTHER PUBLICATIONS

Kirk-Othmer Chemical Dictionary, vol. 17 (1982).
CRC Handbook, Nebergall, 1977-78, p. B-37.
"College Chemistry", Robinson et al., 1980, p. 64s.

*Primary Examiner*—John Niebling
*Assistant Examiner*—Kishor Mayekar
*Attorney, Agent, or Firm*—Felfe & Lynch

[57] ABSTRACT

Disclosed is a composition and a process of using the composition for phosphating a workpiece made of steel or partly galvanized steel in preparation for electroimmersion painting. The cleaned and rinsed workpiece is first activated with a weakly alkaline aqueous solution which contains titanium phosphate and is subsequently dipped into an acid aqueous phosphating solution at a temperature of from 40° to 60° C. which contains 1.8 to 5 g/l Zn,
0.1 to 7 g/l Fe(II),
8 to 25 g/l $P_2O_5$,
5 to 30 g/l $NO_3$ and in which the controlled ratio of free acid to total acid is between 0.04 and 0.07.

The phosphating solution preferably contains 3 g/l zinc and 0.5 to 5 g/l iron(II) and additionally contains up to 3 g/l manganese.

Other suitable components of the phosphating solution are Co, Ni, hydroxylamine, fluorides, tartaric acid, citric acid, and m-nitrobenzene sulfonate.

21 Claims, No Drawings

PROCESS OF PHOSPHATING BEFORE ELECTROIMMERSION PAINTING

This application is a continuation of application Ser. No. 428,013, filed Oct. 26, 1989, abandoned, which is a continuation of application Ser. No. 178,124, filed Apr. 6, 1988, abandoned.

DESCRIPTION

The present invention is in a process for phosphating workpieces made of steel or partly galvanized steel in preparation for electro-immersion painting, wherein a cleaned and rinsed workpiece is first activated with a weakly alkaline aqueous solution which contains titanium phosphate and is subsequently dipped into an acid aqueous phosphating solution which contains zinc phosphate and to the use of that process for preparing a workpiece for cathodic electro-immersion painting.

The practice of treating a steel surface with an acid aqueous phosphating solution which contains zinc/iron(II)/nitrate/phosphate prior to painting the steel surface is known. However, the use of such a process in preparation for electro-immersion painting has revealed substantial disadvantages. For instance, the varying thickness of the phosphate layer formed in the known phosphating processes results in electro-immersion painting coatings having varying thickness and exhibiting surface waves, tears and craters. Additionally, the corrosion resistance often fails to meet the requirements.

It is an object of the invention to provide a process for phosphating steel or partly galvanized steel which results in uniformly covering phosphate layers and is particularly suitable as a preparation for electro-immersion painting.

That object is accomplished in that the process of the kind described first hereinbefore is carried out in accordance with the invention in such a manner that the workpiece is dipped at a temperature of from 40° to 60° C. with a phosphating solution which contains 1.8 to 5 g/l Zn
0.1 to 7 g/l Fe(II)
8 to 25 g/l $P_2O_5$
5 to 30 g/l $NO_3$ and in which the controlled ratio of free acid to total acid is between 0.04 and 0.07.

The process in accordance with the invention is used to treat steel, such as cold-rolled strip and sheet made of soft, unalloyed steels and cold-rolled sheets having a higher strength and made of phosphorus-enriched steel, micro-alloyed steel and dual-phase steels. Zinc layers on galvanized steel may comprise, e.g., layers consisting of Zn, Zn-Fe, Zn+Al, Zn+Al+Si which have been applied by hot dipping and layers consisting of Zn, Zn+Ni, Zn+Fe and applied by electrodeposition.

The process in accordance with the invention may be used with workpieces of different kinds and shapes, such as flat material, deep-drawn parts, welded, seamed and adhesively joined structures. For an effective treatment of the inside surfaces of hollow bodies, an adequate venting and an adequate draining of the liquid must be ensured. Typical workpieces having complex shapes and consisting of different materials are automobile bodies.

The workpieces are initially cleaned in a conventional manner, e.g., with alkaline degreasing agents, and are subsequently rinsed in water. The rinsed workpiece is then treated in a slightly alkaline aqueous solution containing activating titanium phosphate in a fine dispersion.

The phosphating procedure is conducted in a temperature range of from 40° to 60° C. At lower temperatures the phosphating process is too slow for the formation of covering phosphate layers in reasonable time periods. At temperatures above 60° C. the energy losses rise steeply and there is an increasing risk that disturbing dry deposits or crusts will form.

The phosphating process in accordance with the invention is one which is carried out on the "iron side" and for this reason is distinguished by a comparatively small formation of sludge. The initial iron(II) concentration of the baths may be less than 0.1 g/l. After a few passes the concentration will quickly rise into the range called for by the invention due to the removal of material from the steel by the pickling action of the phosphating solution.

It is important to maintain the concentrations of Zn, Fe(II), $P_2O_5$ and $NO_3$ in the above defined ranges to form optimum phosphate layers for the succeeding electro-immersion painting. For instance, if the zinc content is less than 1.8 g/l, the formed phosphate layers provide only an incomplete coverage on the steel surface. When the zinc content is in excess of 5 g/l the formed phosphate layers are too thick for a satisfactory painting. If the Fe(II) content exceeds 7 g/l the quality of the phosphate layers for the succeeding electro-immersion painting will distinctly decrease. If the $P_2O_5$ content is less than 8 g/l, the phosphate content is not sufficient for a proper phosphating. A $P_2O_5$ content in excess of 25 g/l will not afford any additional technological advantages. If the content of $NO_3$ is less than 5 g/l, the baths will not accelerate the formation of the phosphate layer to the required degree. An $NO_3$ content above 30 g/l will not result in a useful further increase of the layer forming rate.

The ratio of free acid to total acid is of great importance in the process of the invention. If that ratio is below 0.04, there is an increased formation of sludge resulting in the loss of valuable components of the phosphating solution. If the ratio exceeds 0.07, the phosphating rate strongly decreases. An optimum ratio can be adjusted by controlling the concentrations of the components of the bath and by an optional addition of further cations, such as Na, K, $NH_4$ or of further anions, such as Cl, $SO_4$.

Particularly good results are obtained in the subsequent electro-immersion painting if, in a preferred embodiment of the invention, the workpiece is contacted by dipping a phosphating solution which contains up to 3 g/l zinc and preferably 0.5 to 5 g/l iron(II).

Layer formation can be modified by the addition to the phosphating solution of other divalent cations, e.g., from the group consisting of Ca, Co, Cu, Mg, Mn, Ni. The workpiece is preferably contacted by dipping a phosphating solution which additionally contains up to 3 g/l manganese and/or up to 3 g/l magnesium. Cobalt may be added preferably in an amount of up to 0.3 g/l and nickel preferably in an amount of up to 0.15 g/l. The presence of cobalt in an amount in excess of 0.3 g/l and/or of nickel in an amount in excess of 0.15 g/l may result in the formation of streaky phosphate layers on steel.

In another preferred embodiment of the invention the workpiece is contacted by dipping a phosphating solution containing hydroxylamine which accelerates the phosphating processing. The hydroxylamine is present in an amount of up to 3 g/l, preferably at least 0.3 g/l. When at least 0.3 g/l of hydroxylamine is present the concentration of nickel can be increased to 0.5 g/l.

To increase the aggressiveness of the phosphating solution, increase the phosphating rate and to optimize the formation of a layer on aluminum-containing zinc surfaces, the phosphating solution can additionally contain up to 3 g/l $SiF_6$ and/or up to 3 g/l $BF_4$ and/or up to 1.5 g/l F.

Tartaric acid and/or citric acid preferably in an amount of up to 3 g/l may be added to reduce the weight of the phosphate layers per unit of area and to further accelerate the formation of the layer.

It is also desirable to use a phosphating solution which contains up to 0.5 g/l, preferably 0.05 to 0.35 g/l of m-nitrobenzene sulfonate. The presence of m-nitrobenzene sulfonate strongly accelerates the phosphating process and distinctly decreases the thickness of the formed phosphate layer. Nitrite-destroying additives, such as urea or amidosulfonic acid, are preferably added to the baths to prevent a shift of the phosphating baths from the iron side to the nitrite side by an autocatalytic formation of nitrite.

In order to avoid an increase of the iron(II) concentration above the desired value, a part of the iron(II) which has been dissolved by the pickling action is oxidized, whereby iron(III) is formed. The iron(III) precipitates as difficultly soluble iron(III) phosphate sludge. In a preferred embodiment of the invention, the phosphating solution is contacted with oxygen-containing gas and/or chlorate and/or peroxide compounds are added to effect the iron(II) oxidation.

The free acid content of the phosphating bath can be decreased by an addition of, e.g., alkali hydroxide and alkali carbonates. It is particularly desirable to use zinc oxide, zinc carbonate and/or manganese carbonate, to introduce additional layer-forming cations into the phosphating solution.

The phosphating process of the invention may be modified in that the dip into the phosphating solution is preceded and/or succeeded by a spraying with the phosphating solution. The dip time usually is in the range of from 2 to 5 minutes and the preceding and/or succeeding spraying may have a duration of from a few seconds to about 0.5 minute.

In a desirable embodiment the phosphating process of the invention, the produced phosphate layers have a weight of 1 to 5 g/m$^2$. This will result in optimum corrosion protection in combination with a formation of paint coatings having a high bond strength when flexed.

The layers formed in the process in accordance with the invention will constitute an effective base coating for paints applied by anodic and cathodic electro-immersion. Particularly desirable results will be produced when the process is carried out in preparation for a cathodic electro-immersion painting which is intended to produce paint films having a thickness in the range of from about 15 to 40 μm. The paint layers applied by electro-immersion may constitute a base paint for additional paint layers or a paint monolayer.

The invention will be explained more in detail and by way of reference to the following Examples.

EXAMPLE

Sheets made of car body steel and galvanized steel were degreased with an alkaline degreasing agent, rinsed in water, activated by being dipped at 40° C. for 1 minute into an aqueous suspension consisting of about 50 mg/l titanium phosphate in an aqueous solution of 1 g/l disodium phosphate and 0.25 g/l tetrasodium pyrophosphate and were subsequently dip-phosphated at 55° C. in the phosphating solutions 1 to 6 listed in the Table.

It was found that the minimum phosphating time was at least 2 to 3 minutes on steel and less than 1 minute on galvanized steel. The minimum phosphating time is the time which is required for the treatment in the phosphating bath to form a phosphate layer which has a visually uniform coverage.

The weight of the layer was between 3.6 and 4.3 g/m$^2$ on steel and between 2.2 and 3.0 g/m$^2$ on zinc.

The free acid (total acid) is defined as the quantity of n/10 NaOH in ml which is required to neutralize a bath sample of 10 ml against dimethyl yellow (phenolphthalein). The ratio of free acid to total acid was (0.054 to 0.063):1.

The phosphating was followed by a water rinsing, a passivating with a chromium-containing afterrinsing solution and an afterrinsing with deionized water. This was followed by electro-immersion painting.

Uniform paint layers were obtained, which without and with additional paint layers exhibited a very strong adhesion to the metallic substrate and an excellent resistance to corrosion. The quality obtained was at least equivalent to that of the known low-zinc phosphating processes with acceleration by chlorate and/or nitrite in baths which contained virtually no iron(II).

TABLE

| | Example | | | | | |
|---|---|---|---|---|---|---|
| | 1 | 2 | 3 | 4 | 5 | 6 |
| Zn (g/l) | 2 | 2 | 2 | 4 | 4 | 4 |
| Fe(II) (g/l) | 1 | 2.5 | 5 | 1 | 2.5 | 5 |
| Ni (g/l) | 0.1 | 0.1 | 0.1 | 0.1 | 0.1 | 0.1 |
| $P_2O_5$ (g/l) | 16 | 16 | 16 | 16 | 16 | 16 |
| $NO_3$ (g/l) | 11 | 11 | 11 | 11 | 11 | 11 |
| Tartaric acid (g/l) | 1 | 1 | 1 | 1 | 1 | 1 |
| $BF_4$ (g/l) | 1.4 | 1.4 | 1.4 | 1.4 | 1.4 | 1.4 |
| Na | The quantity required to obtain the following data by titration | | | | | |
| Free acid (FA) | 1.6 | 2.0 | 2.0 | 1.7 | 1.9 | 2.2 |
| Total acid (TA) | 28.1 | 32.0 | 31.5 | 31.5 | 34.2 | 36.0 |
| Free acid (FA) / Total acid (TA) | 0.057 | 0.063 | 0.060 | 0.054 | 0.056 | 0.060 |
| Minimum phosphating time on steel (min.) | 3 | 3 | 3 | 2 | 2 | 2 |
| Weight of layer on steel (g/m$^2$) | 3.6 | 4.0 | 3.6 | 3.6 | 4.3 | 4.1 |
| Appearance of layer on steel | Gray, finely crystalline and uniform throughout | | | | | |
| Minimum phosphating time on zinc (min.) | Generally less than 1 | | | | | |
| Weight of layer on zinc (g/m$^2$) | 2.2 | 2.6 | 2.2 | 2.5 | 3.0 | 2.9 |
| Appearance of layer on zinc | Gray, finely crystalline and uniform throughout | | | | | |

It will be understood that the specification and examples are illustrative but not limitative of the present invention and that other embodiments within the spirit and scope of the invention will suggest themselves to those skilled in the art.

We claim:

1. A process of phosphating a surface of a workpiece made of steel or partly galvanized steel in preparation for electro-immersion painting comprising:

dipping the activated surface with an acid aqueous phosphating solution at a temperature of from 40° to 60° C., the phosphating solution consisting essentially of 1.8 to 5 g/l Zn,
0.1 to 7 g/l Fe(II),
8 to 25 g/l $P_2O_5$,
5 to 30 g/l $NO_3$
and having a ratio of free acid to total acid of from 0.04 to 0.07; and maintaining the content of divalent iron in the range of 0.1 to 7 g/l in that surplus divalent iron that has entered the phosphating solution is precipitated as iron (III) phosphate by means of at least one of an oxygen-containing gas, a chlorate compound and a peroxide compound.

2. The process of claim 1 wherein the phosphating solution contains 0.5 to 5 g/l iron(II) and zinc in an amount of $0<Zn\leqq 3$ g/l.

3. The process of claim 1 wherein the phosphating solution additionally contains manganese in an amount of $0<Mn\leqq 3$ g/l.

4. The process of claim 1 wherein the phosphating solution additionally contains magnesium in an amount of $0<Mg\leqq 3$ g/l.

5. The process of claim 1 wherein the phosphating solution additionally contains at least one of cobalt in an amount of $0<Co\leqq 3$ g/l. and nickel in an amount of $0<Ni\leqq 0.15$ g.l.

6. The process of claim 1 wherein the phosphating solution contains hydroxylamine in an amount of 0<hydroxylamine≦3 g/l.

7. The process of claim 1 wherein the phosphating solution contains at least one of $SiF_6$ in an amount of $0<SiF_6\leqq 3$ g/l, $BF_4$ in an amount of $0<BF_4\leqq 3$ g/l, and F in an amount of $0<F\leqq 1.5$ g/l.

8. The process of claim 1 wherein the phosphating solution contains at least one acid selected from the group consisting of tartaric acid and citric acid in an amount of 0<acid≦3 g/l.

9. The process of claim 1 wherein the phosphating solution contains m-nitrobenzene sulfonate in an amount of 0<m-nitrobenzene sulfonate≦0.5 g/l.

10. The process of claim 1 wherein the phosphating solution contains a nitrite-destroying substance.

11. The process of claim 10 wherein the nitrite destroying substance is urea or amidosulfonic acid.

12. The process of claim 1 wherein the phosphating solution has a content of free acid which is adjusted by an addition of at least one of zinc oxide, zinc carbonate and manganese carbonate.

13. The process of claim 1 wherein the workpiece surface is contacted with a phosphating solution so as to apply phosphate layers having a weight of from 1 to 5 $g/m^2$.

14. The process of claim 1, where prior to the dipping, the workpiece surface is cleansed, rinsed and activated with a weakly alkaline aqueous solution which contains titanium phosphate.

15. A process of preparing a surface for painting comprising:
cleaning the workpiece surface;
rinsing the workpiece surface;
activating the workpiece surface with a weakly alkaline aqueous solution which contains titanium phosphate;
dipping the activated surface into an acid aqueous phosphating solution at a temperature from 40° to 60° C., the phosphating solution containing
1.8 to 5 g/l Zn,
0.1 to 7 g/l Fe(II),
8 to 25 g/l $P_2O_5$,
5 to 30 g/l $NO_3$
and having a ratio of free acid to total acid of from 0.04 to 0.07; and
applying a coat of paint.

16. The process of claim 15 wherein the paint is applied by cathodic electro-immersion painting.

17. A phosphating solution comprising:
1.8 to 5 g/l Zn,
0.1 to 7 g/l Fe(II),
8 to 25 g/l $P_2O_5$,
5 to 30 g/l $NO_3$
and having a ratio of free acid to total acid of from 0.04 to 0.07.

18. The process of claim 6 wherein the solution contains at least 0.3 g/l of hydroxylamine.

19. The process of claim 9 wherein the solution contains 0.05 to 0.35 g/l of m-nitrobenzene sulfonate.

20. The process of claim 1 wherein the workpiece is sprayed with the phosphating solution after the dipping.

21. The process of claim 6 wherein the phosphating solution contains at least 0.3 g/l hydroxylamine and nickel in an amount of $0<Ni\leqq 0.5$ g/l.

* * * * *